United States Patent [19]

Curley, Jr.

[11] Patent Number: 4,484,397

[45] Date of Patent: Nov. 27, 1984

[54] STABILIZATION DEVICE

[76] Inventor: John J. Curley, Jr., 10 Colonial Village Dr., Arlington, Mass. 02174

[21] Appl. No.: 506,340

[22] Filed: Jun. 21, 1983

[51] Int. Cl.[3] ..... A43B 7/14; A43B 7/20

[52] U.S. Cl. ..... 36/92; 36/68; 36/69; 36/132

[58] Field of Search ..... 36/92, 68, 69, 114, 36/132, 136, 89, 90, 129

[56] References Cited

U.S. PATENT DOCUMENTS

| | | | |
|---|---|---|---|
| 226,792 | 4/1880 | Robinson | 36/69 |
| 729,761 | 6/1903 | Harland | 36/69 |
| 959,956 | 5/1910 | Moorefield | 36/69 |
| 1,188,717 | 6/1916 | Bennett | 36/69 |
| 1,830,091 | 11/1931 | Cox | 36/69 |
| 2,965,983 | 12/1960 | Griffin | 36/89 |
| 4,287,675 | 9/1981 | Norton et al. | 36/68 |
| 4,402,146 | 9/1983 | Parracho et al. | 36/69 |

*Primary Examiner*—Werner H. Schroeder
*Assistant Examiner*—Steven N. Meyers
*Attorney, Agent, or Firm*—William E. Noonan

[57] ABSTRACT

A stabilization device for controlling the degree of roll of a running shoe which includes at least upper and lower laminar sole elements including an upper plate superposed on and substantially conforming to the top surface of the upper sole element, a lower plate spaced from said and interposed between the upper and lower sole elements and a side wall extending between and connected to the upper and lower plates and substantially conforming to the side of the upper sole element.

11 Claims, 16 Drawing Figures

STABILIZATION DEVICE

FIELD OF INVENTION

This invention relates to an improved apparatus for controlling foot roll when running. When the apparatus is inserted in a running shoe, it enhances the stability of the shoe and helps prevent over-pronation of the knee while running.

BACKGROUND OF INVENTION

Various devices are presently employed for helping in the control of over pronation of the knee while running. Typically, these stabilizing devices are inserted in and around the sole, midsole or wedge of running shoes. Certain stabilizing devices incorporate the method of using midsole materials of different densities and compressabilities, resulting in the stiffening of certain sections of the running shoe soles. Thus, the control of over-pronation can be achieved to a degree.

One of the disadvantages of this method is that the midsoles have to be constructed of more than one type of cushioning material, thus complicating construction.

SUMMARY OF INVENTION

It is, therefore, the object of this invention to provide an improved stabilizing device that can be attached during manufacturing to most running shoes without significantly changing the design of the shoe.

It is further the object of this invention to provide a stabilizing device that can be used with running shoes of single density midsole and wedge materials thus simplifying manufacturing procedures.

It is further the object of this invention to provide an improved uniformly sized stabilizing device which fits a wide variety of sizes and width of running shoes.

It is further the object of this invention to provide an improved stabilizing device that is compatible and can be used in conjunction with stabilizing plates presently being employed.

This invention features a stabilization device constructed of a lightweight yet ridged material, such as plastic, having a top plate which is permanently placed, and preferably adhered, using glue or other means, between the bottom of the heel counter and the top of the heel wedge of a running shoe. The top plate substantially conforms to the top surface of the heel wedge and may itself be covered by an insole. A lower plate is inserted between and similarly permanently fixed to the bottom of the heel wedge and the top surface of the sole element, typically the midsole layer, of the running shoe. A side wall interconnects the upper and lower plates and includes an inside surface which substantially conforms to the outside edge surface of the heel wedge. The width of the side wall is thus approximately equal to the width of the heel wedge.

In preferred embodiments, the upper and lower plates are integrally interconnected to the side wall such that a single molded piece is provided. An extension portion may also be attached, typically integrally to the upper plate. This extension portion is preferably also composed of a lightweight plastic material and includes an inside surface which substantially conforms to the outside surface of the heel counter in the running shoe upper.

Typically, the device is incorporated into the running shoe prior to assembly of the shoe, e.g., the upper plate is inserted between the heel counter and heel wedge and the lower plate is inserted between the heel wedge and midsole before the running shoe upper, insole, heel wedge and midsole are permanently joined.

In certain embodiments wherein the midsole is arranged above the heel wedge, the device is fitted about the midsole. In other multiple layer shoe sole arrangements, the stabilizing device is fitted about the upper sole element.

The device is preferably attached to the inside edge of the running shoe. Thus, this invention, when employed in a running shoe, will allow both the heel wedge portion and the heel midsole portion of a running shoe to compress on the outside area as the shoe strikes the running surface; yet it prevents the upper heel wedge portion from compressing as the lower heel midsole compresses on the inside area of the shoe as the runner's foot rolls inward—thus controlling the inward roll and preventing exessive pronation.

The device may be applied to just the inside of the shoe or alternatively may extend peripherally about the upper sole element (typically the heel wedge) from the inside to outside edge thereof. Preferably each plate includes a thick region proximate the side wall and a thin region proximate the distal end thereof. One or both of the plates may include a wide section for enhancing stability and a narrow section for enhancing compression.

In an alternative embodiment, one or more spikes may be substituted for the lower plate. Such spikes extend from the side wall and are inserted into the upper sole element (typically the heel wedge).

Other objects, features and advantages of the invention will become apparent from the following detailed description of the preferred embodiment with reference therein to the accompanying drawings in which:

A BRIEF DESCRIPTION OF THE DRAWINGS

DETAILED DESCRIPTION OF PREFERRED EMBODIMENTS

Figure 1:
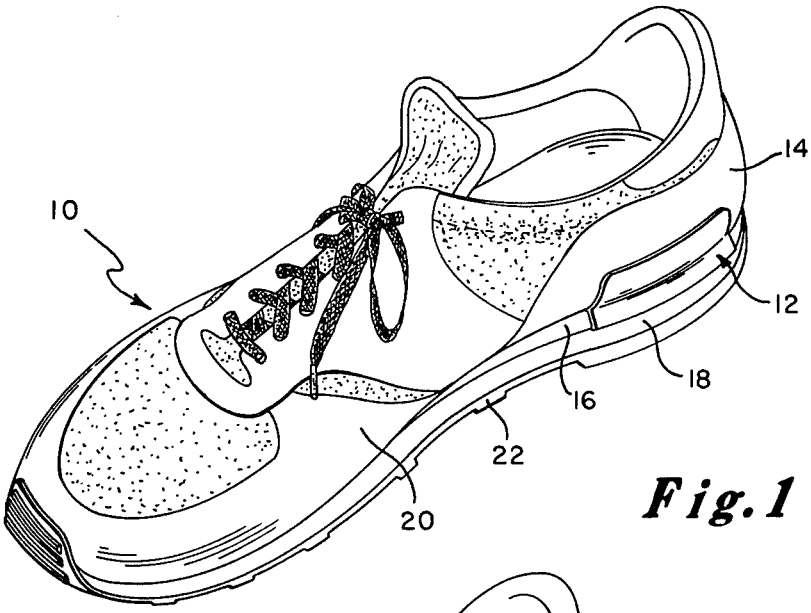
FIG. 1 is an isometric view of the stabilizer apparatus of this invention as it would appear in a right hand running shoe.
Figure 3:
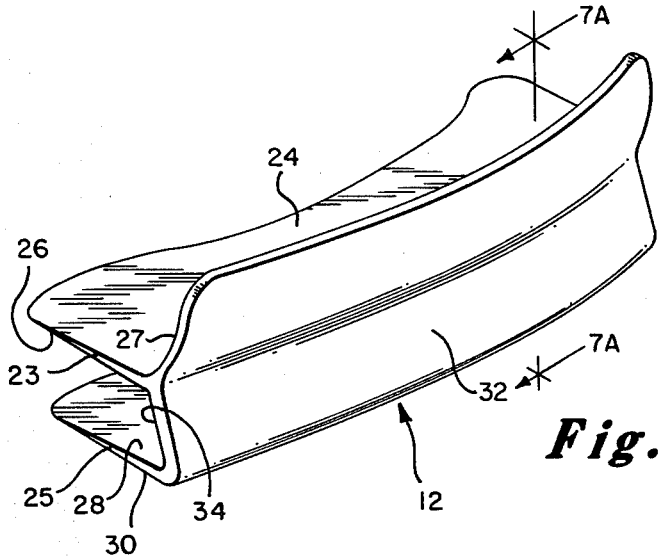
FIG. 3 is an isometric view of the preferred embodiment of the stabilizer apparatus of this invention. The running shoe has been omitted for clarity.

There is shown in FIG. 1, a running shoe 10, having a stabilization device 12, according to this invention, permanently attached between the bottom of heel counter 14, and the top of heel wedge 16, and the bottom of heel wedge 16, and the top of midsole 18. As best shown in FIG. 3, device 12 includes upper and lower plates 23, 25, a side wall 32 and an extension portion 29. These elements are molded together in a single integral piece.

Figure 2:
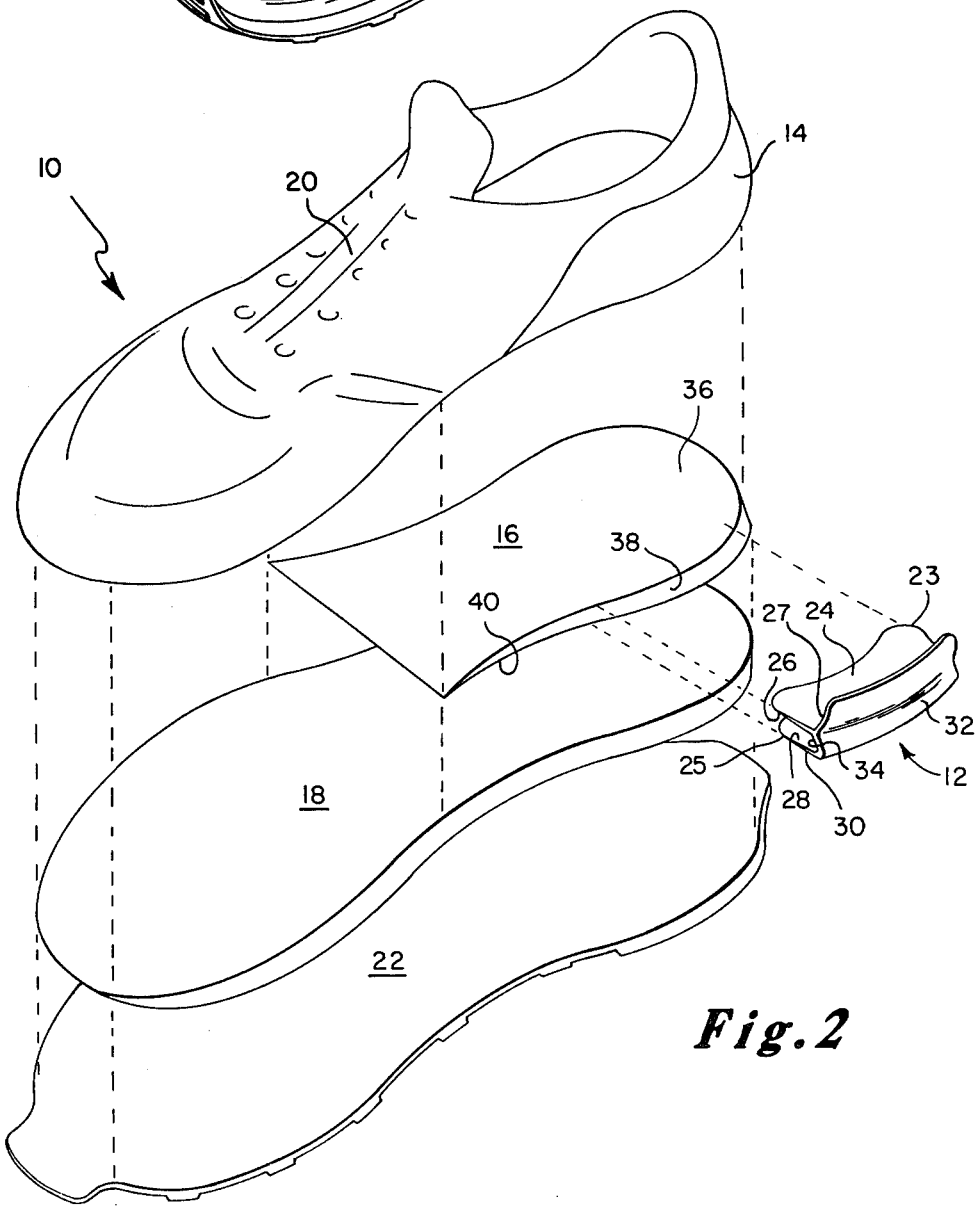
FIG. 2 is an exploded isometric view of the stabilizer apparatus of this invention as it would be employed in a right hand running shoe.

There is shown in FIG. 2, an exploded view of running shoe 10, showing the upper portion 20, which includes heel counter 14, heel wedge 16, midsole 18, outsole 22, and the stabilizer device 12.

Stabilizer 12 is attached permanently to the inside of heel wedge 16 by using glue or other means. The bottom surface 26 of upper plate 23, of stabilizer device 12, substantially conforms and is joined to top surface 36, of heel wedge 16, while inside surface 34 of side wall 32 is joined to surface 38 of wedge 16 and surface upper 28 of lower plate 25 is joined to surface 40. Surface 27 of extension piece 29 which conforms to the outer surface of heel counter 14 is also permanently attached to the heel counter.

Upper portion 20, heel wedge 16, with stabilizer 12 attached, midsole 18, and outsole 22, and then joined permanently together. An insole (not shown) may be superposed over wedge 16 and midsole 18.

Figure 4A:
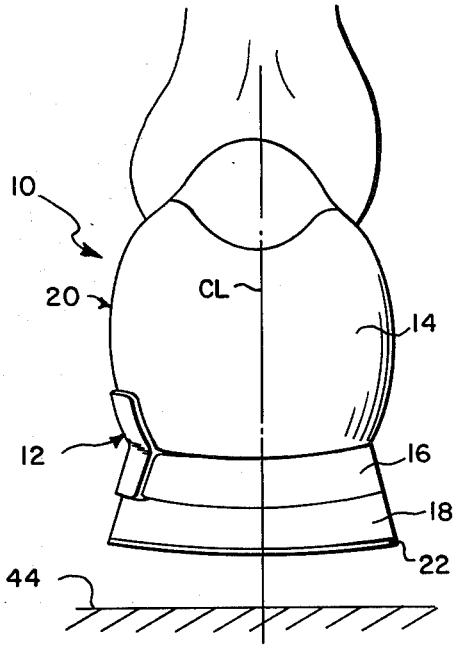
FIG. 4A–4C are diagrammatic rear views of the stabilizer apparatus showing the running shoe before it strikes the ground, as it strikes the ground, and as it rolls in on the medial side of the bottom surface, respectively.

The enlarged view of stabilizer 12, shown in FIG. 3, more clearly illustrates the tapering of the thickness of both horizontal plates 23 and 25, from their thickest points at their junction with vertical wall 32, to their thinnest point at their extreme edges. This allows the device, once placed in a running shoe, not to be felt by the runner's heel. Views 4A–4C show diagrammatically the function of stabilizer 12. Before the shoe 10, strikes the running surface 44, FIG. 4A, heel wedge 16, and midsole 18 are in a relaxed state.

Figure 4B:
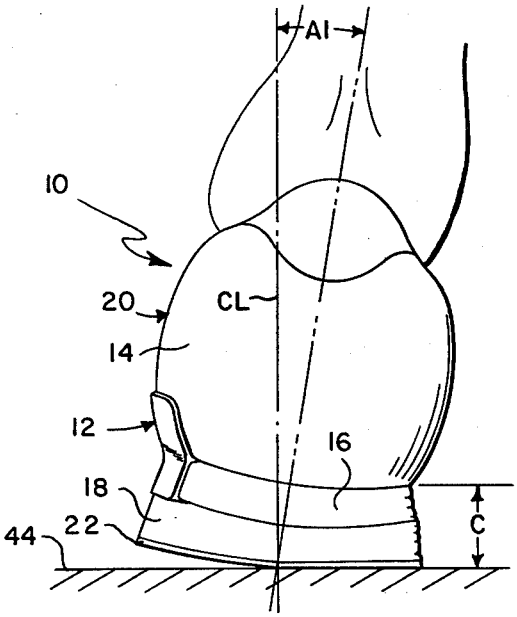
Figure 4C:
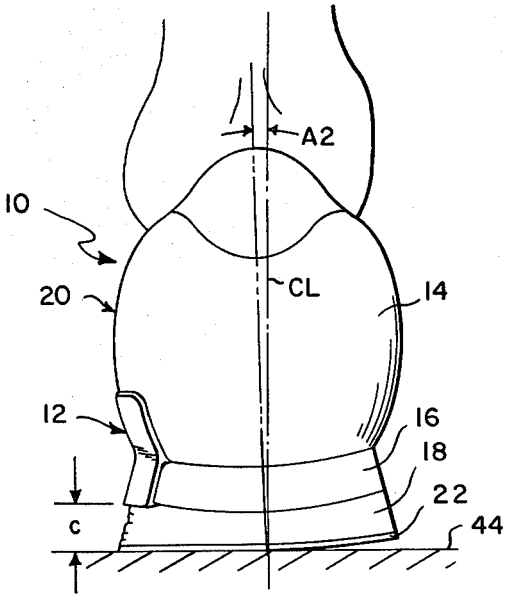
Figure 5:
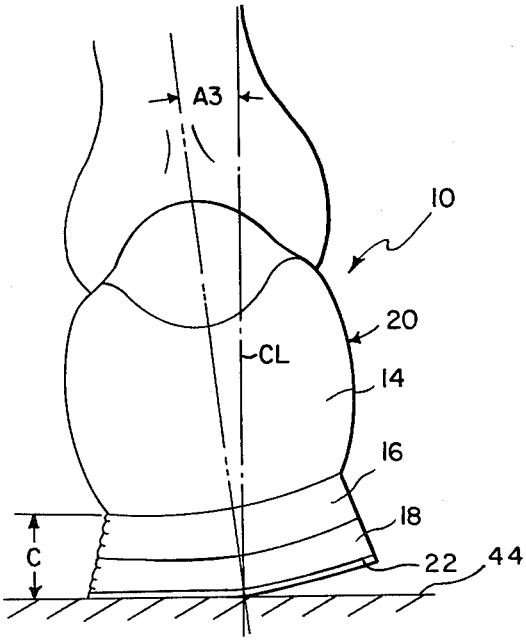
FIG. 5 is a diagrammatic rear view of a running shoe as it rolls in on the medial side of the bottom surface without a stabilizing apparatus.

Upon impact, FIG. 4B, the outside portion of the right hand running shoe 10, compresses along the outside areas of both heel wedge 16, and midsole 18. The angle of the shoe on impact is indicated by A1. The compression is indicated by C. As the foot rolls inward, FIG. 4C, stabilizer 12 prevents the compression of heel wedge 16, yet permits compression of midsole 18. This compression is indicated by c. The degree of inward roll is indicated by A2. FIG. 5 shows diagrammatically what would happen without stabilizer 12 in place. This angle of inward roll without the use of a stabilization device is indicated by A3.

Figure 6A:
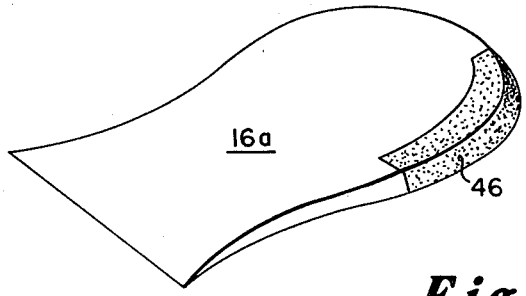
FIG. 6A & 6B are perspective views of prior art.
Figure 6B:
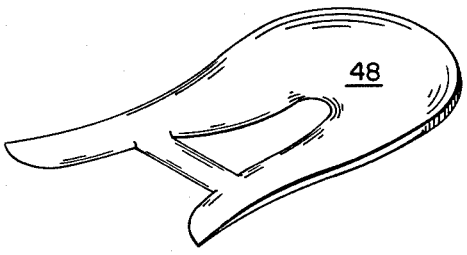

FIG. 6A and FIG. 6B show means presently being used to help prevent excessive inward roll. **16*a* is a modified version of heel wedge 16 with stiffer section 46 added. FIG. 6B is a stabilizer plate 48 which is attached between upper portion 20 and heel wedge 16, FIG. 1**.

Figure 7A:
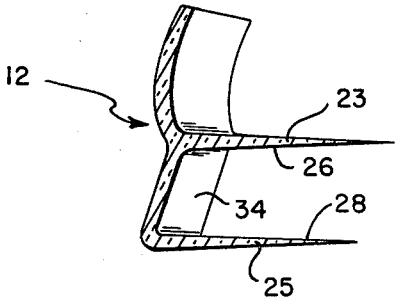
FIG. 7A is a cross-sectional elevation view of the device shown in FIG. 3.

FIG. 7A shows stabilizer 12 sectioned along line 7A of FIG. 3.

Figure 7B:
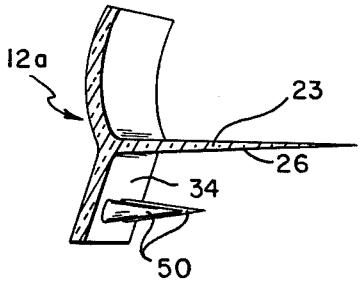
FIG. 7B is a cross-sectional elevational view, similar to FIG. 7A, employing an alternative plurality of spikes on the inside of the vertical surface. The spikes could thus penetrate the side surface of either the heel wedge portion or the heel midsole portion.

FIG. 7B is an alternative embodiment **12*a* of the stabilizer wherein a plurality of spikes 50 are placed along surface 34, and plate 25 is thus eliminated. The spikes 50, by piercing the side of heel wedge 16, achieve substantially the same effect as plate 25**.

Figure 8:
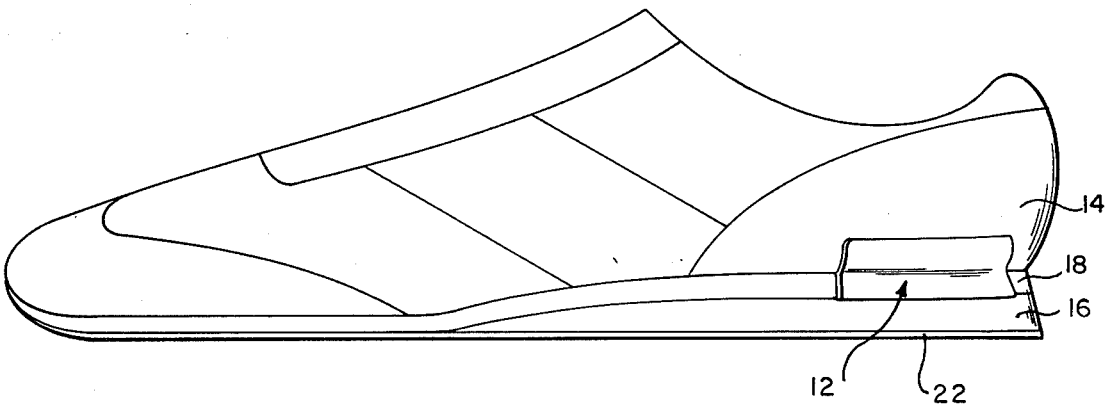
FIGS. 8 through 12 are perspective views of alternative embodiments of the device.

Certain running shoes are constructed in such a manner that the order of assembly of heel wedge 16 and midsole 18 are reversed. As shown in FIG. 8, this does not change the position of stabilizer 12, as it is placed over and attached about midsole 18 instead. The obscured upper plate is superposed on the top surface of the midsole and the lower plate is interposed between the midsole 18 and the heel wedge 16 there below.

Figure 9:
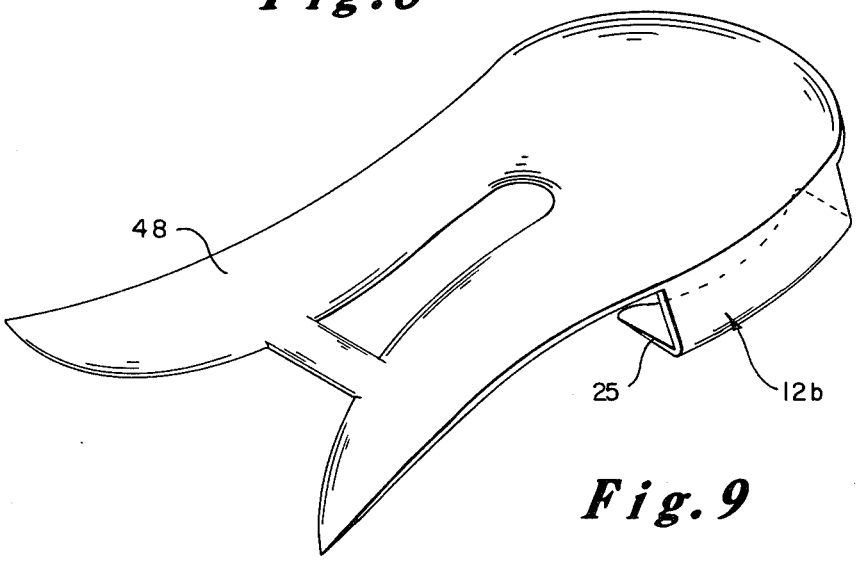

FIG. 9 shows an alternate embodiment whereby top horizontal plate 23 is substituted by using stabilizer plate 48 FIG. 6B of the prior art.

Figure 10:
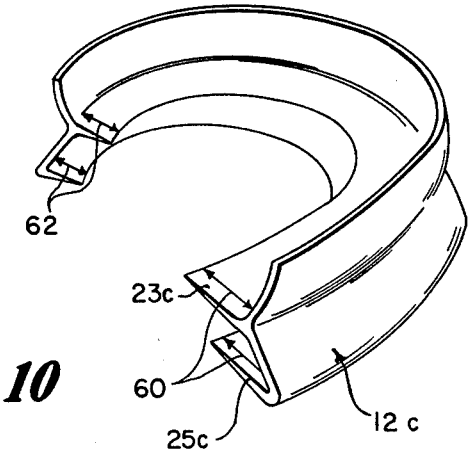

FIG. 10 is an alternate embodiment **12*c* whereby top horizontal plate 25*c*, and bottom plate 23*c*, wrap around the omitted heel wedge from the inside to the outside of the shoe. Varying degrees of stabilization are achieved by changing the width of horizontal plates 25*c* and 23*c* along lines 60 and 62**. Where these horizontal plates are wider, more stability exists.

Figure 11:
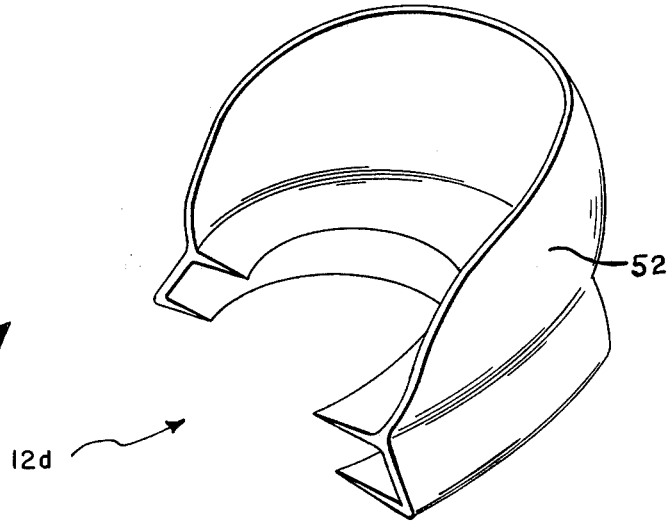

FIG. 11 is an alternate embodiment whereby the addition of a heel cup 52, is added to stabilizer **12*d* in place of the extension portion 29, FIG. 3**. Enhanced support is provided for the heel area.

Figure 12:
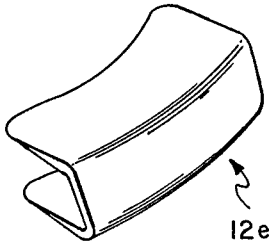

FIG. 12 is an alternate embodiment whereby no heel support surface (e.g. neither an extension portion 29, FIG. 3 nor a heel cup 52, FIG. 11) is used.

It is evident those skilled in the art, once given the benefit of the foregoing disclosure, may now make numerous other uses and modifications of, and departures from, the specific embodiment described therein without departing from the inventive concepts. Consequently, the invention is to be construed as embracing each and every novel feature and novel combination of features present in, or possessed by, the apparatus and techniques herein disclosed and limited solely by the spirit and scope of the appended claims.

What is claimed is:

1. A stabilizing device for controlling the degree of roll of a running shoe, which includes at least upper and lower laminar sole elements comprising:

an upper plate superposed on and substantially conforming to the top surface of the upper sole element, a lower plate spaced from said upper plate and interposed between said upper and lower sole elements, and a side wall extending between and connected to said upper and lower plates and substantially conforming to the side of the upper sole element.

2. The device of claim 1 further including means for permanently adhering said device to at least one of the upper and lower sole elements.

3. The device of claim 1 in which said upper and lower plates and said side wall are integrally connected.

4. The device of claim 1 in which the shoe includes an upper part and further comprising an extension portion attached to and extending from said upper plate and substantially comforming to the upper part for lending support thereto.

5. The device of claim 4 in which said extension portion is integrally connected to said upper plate.

6. The device of claim 1 in which said side wall extends along the inside edge of the upper sole element.

7. The device of claim 1 in which said side wall extends peripherally about the upper sole element from the inside to the outside edge thereof.

8. The device of claim 7 in which at least one of the plates has a relatively wide width extending inwardly from the inside edge of the shoe and a relatively narrow width extending inwardly from the outside edge of the shoe.

9. The device of claim 1 in which one of the upper and lower sole elements includes a heel wedge.

10. The device of claim 1 in which one of the upper and lower sole elements includes a midsole.

11. The device of claim 1 in which said upper and lower plates each include a relatively thick region proximate said side wall and a relatively thin region at the distal end thereof.

* * * * *